US006857858B2

(12) United States Patent
Jeun

(10) Patent No.: US 6,857,858 B2
(45) Date of Patent: Feb. 22, 2005

(54) DEVICE AND METHOD FOR CONTROLLING PISTON POSITION IN LINEAR COMPRESSOR

(75) Inventor: Young Hwan Jeun, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 60 days.

(21) Appl. No.: 10/181,371

(22) PCT Filed: Dec. 18, 2000

(86) PCT No.: PCT/KR00/01488

§ 371 (c)(1),
(2), (4) Date: Nov. 5, 2002

(87) PCT Pub. No.: WO01/54253

PCT Pub. Date: Jul. 26, 2001

(65) Prior Publication Data

US 2003/0129063 A1 Jul. 10, 2003

(30) Foreign Application Priority Data

Jan. 21, 2000 (KR) ..... 2000-2829

(51) Int. Cl.[7] ..... F04B 49/06

(52) U.S. Cl. ..... 417/45; 417/44.11; 417/53; 417/417

(58) Field of Search ..... 417/45, 53, 63, 417/44.1, 44.11, 417, 488, 415; 361/187; 62/228.1, 230

(56) References Cited

U.S. PATENT DOCUMENTS 4,345,442 A * 8/1982 Dorman ..... 62/160
5,032,772 A * 7/1991 Gully et al. ..... 318/135
5,496,153 A * 3/1996 Redlich ..... 417/212
5,947,693 A * 9/1999 Yang ..... 417/45
6,199,381 B1 * 3/2001 Unger et al. ..... 60/520
6,231,310 B1 * 5/2001 Tojo et al. ..... 417/44.1

* cited by examiner

*Primary Examiner*—Charles G. Freay
(74) *Attorney, Agent, or Firm*—McKenna Long & Aldridge LLP

(57) ABSTRACT

Device and method for controlling a piston position in a linear compressor, having a power source, a triac, and a motor, the device including a current phase detecting part for detecting a current switched at the triac, integrating the current, and generating a first square wave corresponding to the integrated current, a stroke phase detecting part for generating an AC voltage waveform having a fixed frequency and varied amplitude according to a piston reciprocation position following motor operation, and generating a second square wave corresponding to the AC voltage waveform, a zero cross detecting part for detecting a zero crossing of the voltage supplied from the power source, and a controlling part for generating a signal for controlling a piston position according to a phase difference of the first square wave detected at the current phase detecting part and the second square wave detected at the stroke phase detecting part, thereby making an efficiency and a reliability the best by controlling a piston position in a cylinder such that a top clearance becomes a minimum according to a phase difference of a current square wave and stroke square wave.

20 Claims, 7 Drawing Sheets

DEVICE AND METHOD FOR CONTROLLING PISTON POSITION IN LINEAR COMPRESSOR

TECHNICAL FIELD

The present invention relates to a linear compressor, and more particularly, to device and method for controlling a piston position in a linear compressor.

BACKGROUND ART

A background art device and method for controlling a piston position in a linear compressor will be explained with reference to the attached drawings. FIG. 1 illustrates one example of the background art device for controlling a piston position in a linear compressor, and FIG. 2 illustrates waveforms of high, regular, and low voltages from the AC-DC voltage transformer in FIG. 1, and FIG. 3 explains a definition of top clearance.

Referring to FIG. 1, one example of the background art device for controlling a piston position in a linear compressor is provided with a power source 1 for supplying AC 220V, a triac 2 for switching AC 220 volt from the power source 1 in response to a control signal, a motor 3 operative by AC220V switched thereto through the triac 2 for reciprocating a piston, a stroke generator 4 for generating an AC voltage waveform having a fixed frequency and varied amplitude according to a piston reciprocating position, a rectifying circuit 5 for rectifying the AC voltage waveform generated at the stroke generator 4, a filter circuit 6 for filtering the voltage waveform rectified at the rectifying circuit 5 into a DC voltage waveform, an AC-to-DC voltage transformer 7 for transforming the DC voltage waveform filtered at the filtering circuit 6 into a corresponding DC voltage, a zero cross detecting circuit 8 for detecting a zero crossing of AC 220V supplied from the power source 1, a microcomputer 9 for converting the DC voltage from the AC-to-DC voltage transformer 7 into a length of piston reciprocation corresponding to the DC voltage, comparing the length of the piston reciprocation to a preset value, and providing a control signal according to a result of the comparison, and a phase controlling part 10 for controlling a firing angle to control a stroke in response to a control signal from the microcomputer 9.

The operation of the background art device for controlling a piston position in a linear compressor of the present invention will be explained.

When the phase controlling part 10 provides a triggering signal for a firing angle at an initial drive of the linear compressor, the triac 2 switches AC220V from the power source 1 to the motor 3, so that the motor 3 reciprocates the piston in a cylinder. In this instance, the stroke generator 4 generates an AC voltage waveform having a fixed frequency: and varied amplitude according to a piston reciprocation position. And, the rectifier circuit 5 rectifies the AC voltage waveform generated at the stroke generator 4, and the filter circuit 6 filters the voltage waveform rectified at the rectifying circuit 5 into a DC voltage waveform. Then, the AC-to-DC voltage transformer 7 transforms the DC voltage waveform filtered at the filtering circuit 6 into a DC voltage corresponding to the DC voltage waveform. And, the zero crossing detection circuit 8 detects a zero crossing of the AC220V from the power source 1, and provides a signal of a zero crossing detection result. According to this, the microcomputer 9 converts the DC voltage from the AC-to-DC voltage transformer 7 into a length of piston reciprocation, compares to a preset value, and provides a control signal according to a result of the comparison. That is, the microcomputer 9 converts the DC voltage from the AC-to-DC voltage transformer 7 into a length of piston reciprocation corresponding to the DC voltage, compares to a preset length for a regular stroke voltage under a regular pressure, and, as shown in FIG. 2, as a result of the comparison, if the DC voltage from the AC-to-DC voltage transformer 7 is a stroke voltage at a high pressure or a low pressure, provides a control signal for altering the stroke voltage into a stroke voltage at a regular pressure. Then, the phase controller 10 provides a signal for controlling a firing angle to control the stroke in response to the control signal from the microcomputer 9. That is, the phase controller 10 provides a control signal for reducing a firing angle according to a control signal for altering a high pressure stroke voltage from the microcomputer 9 into a regular pressure stroke voltage, or a control signal for increasing a firing angle according to a control signal for altering a low pressure stroke voltage from the microcomputer 9 into a regular pressure stroke voltage. According to this, the triac 2, triggered by the control signal from the phase controller 10, controls a voltage phase of the AC220V from the power source 1, and the motor 3 reciprocates the piston in the cylinder according to a phase controlled at the triac 2. That is, the triac 2 controls the voltage phase of the AC220V from the power source 1 according to a control signal for reducing the firing angle from the phase controller 10, to reduce a current to the motor 3, such that the motor 3 in turn reduces the piston reciprocation length in the cylinder shorter, or the triac 2 controls the voltage phase of the AC220V from the power source 1 according to a control signal for increasing the firing angle from the phase controller 10, to increase a current to the motor 3, such that the motor 3 in turn increases the piston reciprocation length in the cylinder shorter. Thus, by repeating the foregoing process, the microcomputer 9 converts the DC voltage from the AC-to-DC voltage transformer caused by the piston reciprocation in the cylinder into a piston stroke length corresponding to the DC voltage, for controlling a piston position.

However, the background art device and method for controlling a piston position in a linear compressor has the following problems.

First, the system is complicated as it involves the rectifying circuit, the filtering circuit, and the AC-to-DC voltage transformer. In addition, there is a difference between actual position and feedback position because of much error at a stroke-feedback device. This error is related to an error at the circuits inclusive of the errors at the motor and the mechanical components. No matter how precisely the system is fabricated, occurrence of collision between the piston and the valves, efficiency deterioration, and increased noise caused by error are not avoidable.

Second, the system has a poor load estimation capability such that, as shown in FIG. 3, load variation at a top clearance portion can not be estimated. That makes it very difficult to control the system, and to predict any environmental variation (e.g., temperature variation) and non-regular characteristics in a set state (e.g., gas leakage, cycle blocking).

DISCLOSURE OF INVENTION

Accordingly, the present invention is directed to device and method for controlling a piston position in a linear compressor that substantially obviates one or more of the problems due to limitations and disadvantages of the related art.

An object of the present invention is to provide a device and method for controlling a piston position in a linear compressor, in which a piston position in a cylinder is controlled by minimizing a top clearance.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the device for controlling a piston position in a linear compressor, having a power source, a triac, and a motor, includes a current phase detecting part for detecting a current switched at the triac, integrating the current, and generating a first square wave corresponding to the integrated current, a stroke phase detecting part for generating an AC voltage waveform having a fixed frequency and varied amplitude according to a piston reciprocation position following motor operation, and generating a second square wave corresponding to the AC voltage waveform, a zero cross detecting part for detecting a zero crossing of the voltage supplied from the power source, and a controlling part for generating a signal for controlling a piston position according to a phase difference of the first square wave detected at the current phase detecting part and the second square wave detected at the stroke phase detecting part.

The current phase detecting part includes a current detecting part for detecting a current switched at the triac, an integrating part for integrating the current detected at the current detecting part, and a first square wave generating part for generating the first square wave corresponding to the current integrated at the integrating part.

The stroke phase detecting part includes a stroke generating part for generating the AC voltage waveform having a fixed frequency and varied amplitude according to a piston reciprocation position, and a second square wave generating part for generating the second square wave corresponding to the AC voltage waveform generated at the stroke generating part.

The controlling part detects a piston position at which the top clearance becomes a minimum according to a phase difference of the first and the second square waves and provides a signal for controlling the piston position at which the top clearance becomes the minimum.

The device for controlling a piston position in a linear compressor further includes a rectifying part for rectifying the voltage waveform of the stroke detected at the phase detecting part, and an AC-to-DC converting part for converting the rectified voltage waveform into a DC waveform.

In another aspect of the present invention, there is provided a method for controlling a piston position in a linear compressor having a power source, a triac, and a motor, including the steps of (1) generating a first square wave corresponding to a current of a voltage switched at the triac, (2) generating a second square wave corresponding to a stroke occurred as the motor is operated by the voltage, and (3) controlling a piston position by controlling a phase of voltage switched at the triac according to a phase difference of the first square wave and the second square wave.

The step (3) is the step for providing a control signal for controlling a piston position such that a top clearance becomes a minimum according to a phase difference of the first and second square waves.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

BEST MODE FOR CARRYING OUT THE INVENTION

Figure 4:
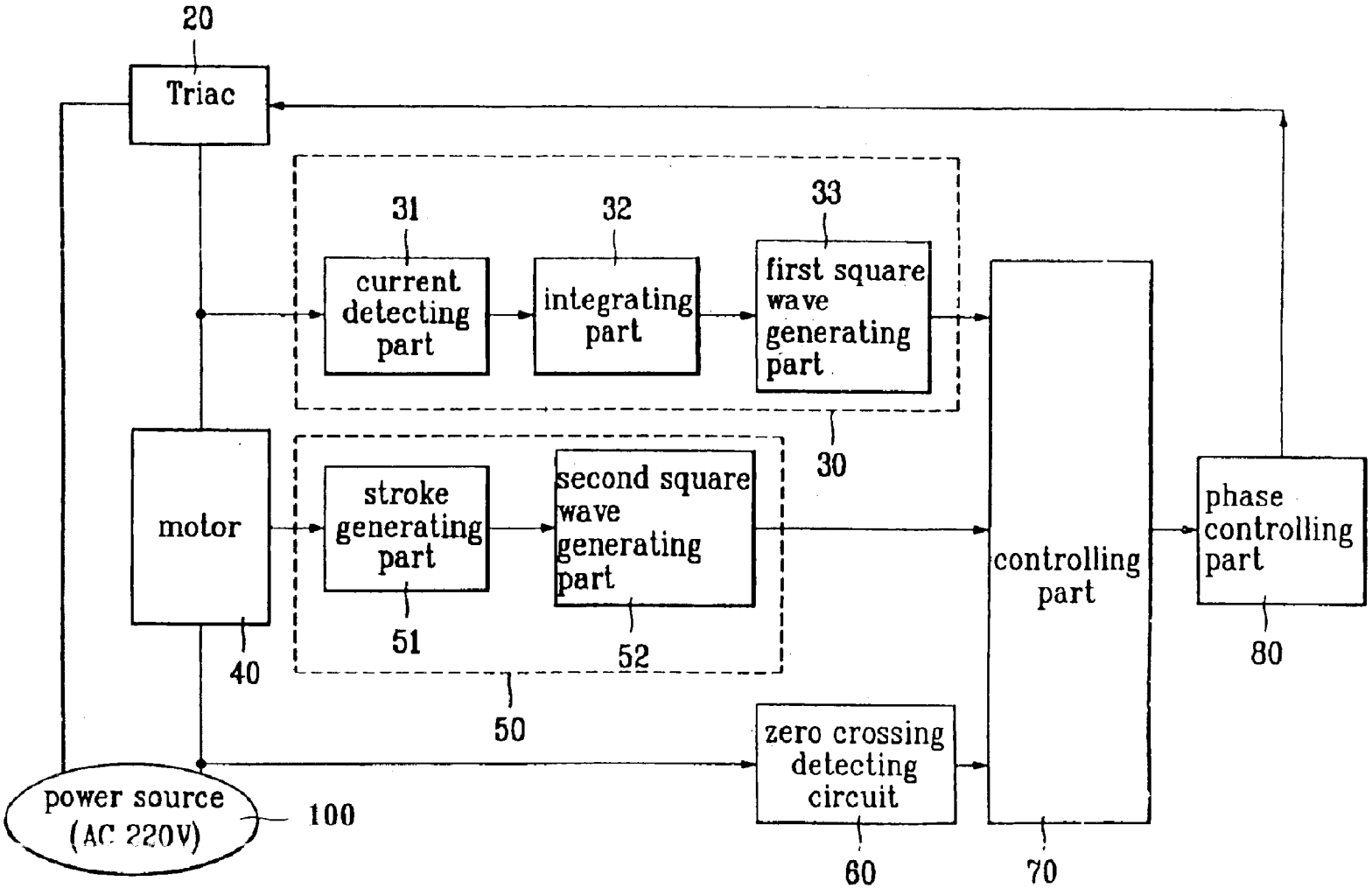
FIG. 4 illustrates a device for controlling a piston position in a linear compressor in accordance with a first preferred embodiment of the present invention.

Reference will now be made in detail to the preferred embodiments of the present invention, examples of which are illustrated in the accompanying drawings. FIG. 4 illustrates a device for controlling a piston position in a linear compressor in accordance with a first preferred embodiment of the present invention.

Referring to FIG. 4, the device for controlling a piston position in a linear compressor in accordance with a first preferred embodiment of the present invention includes a power source 100 for supplying AC 220V, a triac 20 for switching AC 220 volt from the power source 100 in response to a control signal, a current phase detecting part 30 for detecting the current switched through the triac 20, integrating the current, and generating a first square wave corresponding to the integrated current, a motor 40 operative on the AC220V switched thereto through the triac 20 for reciprocating a piston in a cylinder, a stroke phase detecting part 50 for generating an AC voltage waveform having a fixed frequency and varied amplitude according to a piston reciprocation position and generating a second square wave corresponding to the AC voltage waveform, a zero cross detecting circuit 60 for detecting a zero crossing of the AC 220V supplied from the power source, a controlling part 70 for generating a signal for controlling a piston position according to a phase difference between the first square wave provided from the current phase detecting part 30 and the second square wave provided from the stroke phase detecting part 50, and a phase controlling part 80 for controlling a firing angle to control a stroke in response to a control signal from the controlling part 70. The current phase detecting part 30 includes a current detecting part 31 for detecting a current switched through the triac 20, an integrating part 32 for integrating the current detected at the current detecting part 31, and a first square wave generating part 33 for generating the first square wave corresponding to the current integrated at the integrating part 32. The stroke phase detecting part 50 includes a stroke generating part 51 for generating the AC voltage waveform having a fixed frequency and varied amplitude according to a piston reciprocation position, and a second square wave generating part 52 for generating the second square wave corresponding to the AC voltage waveform generated at the stroke generating part 51.

Figure 5:
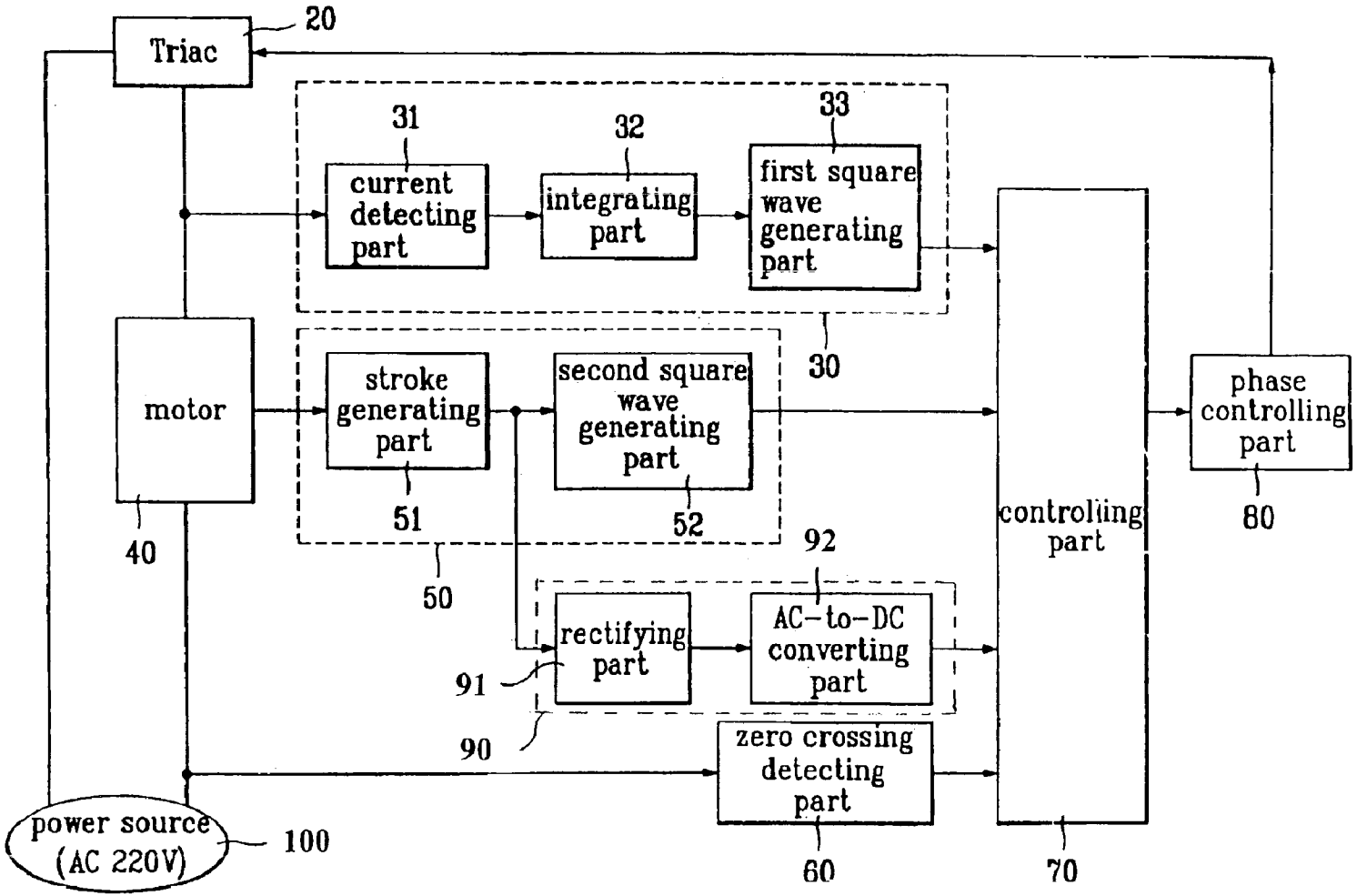
FIG. 5 illustrates a device for controlling a piston position in a linear compressor in accordance with a second preferred embodiment of the present invention.

FIG. 5 illustrates a device for controlling a piston position in a linear compressor in accordance with a second preferred embodiment of the present invention, which includes a converting part 90, additionally. The converting part 90 includes a rectifying part 91 for rectifying the AC voltage waveform generated at the stroke generating part 51, and an AC-to-DC converting part 92 for converting the AC voltage waveform rectified at the rectifying part 91 in a DC voltage waveform corresponding to the AC voltage waveform.

Figure 6:
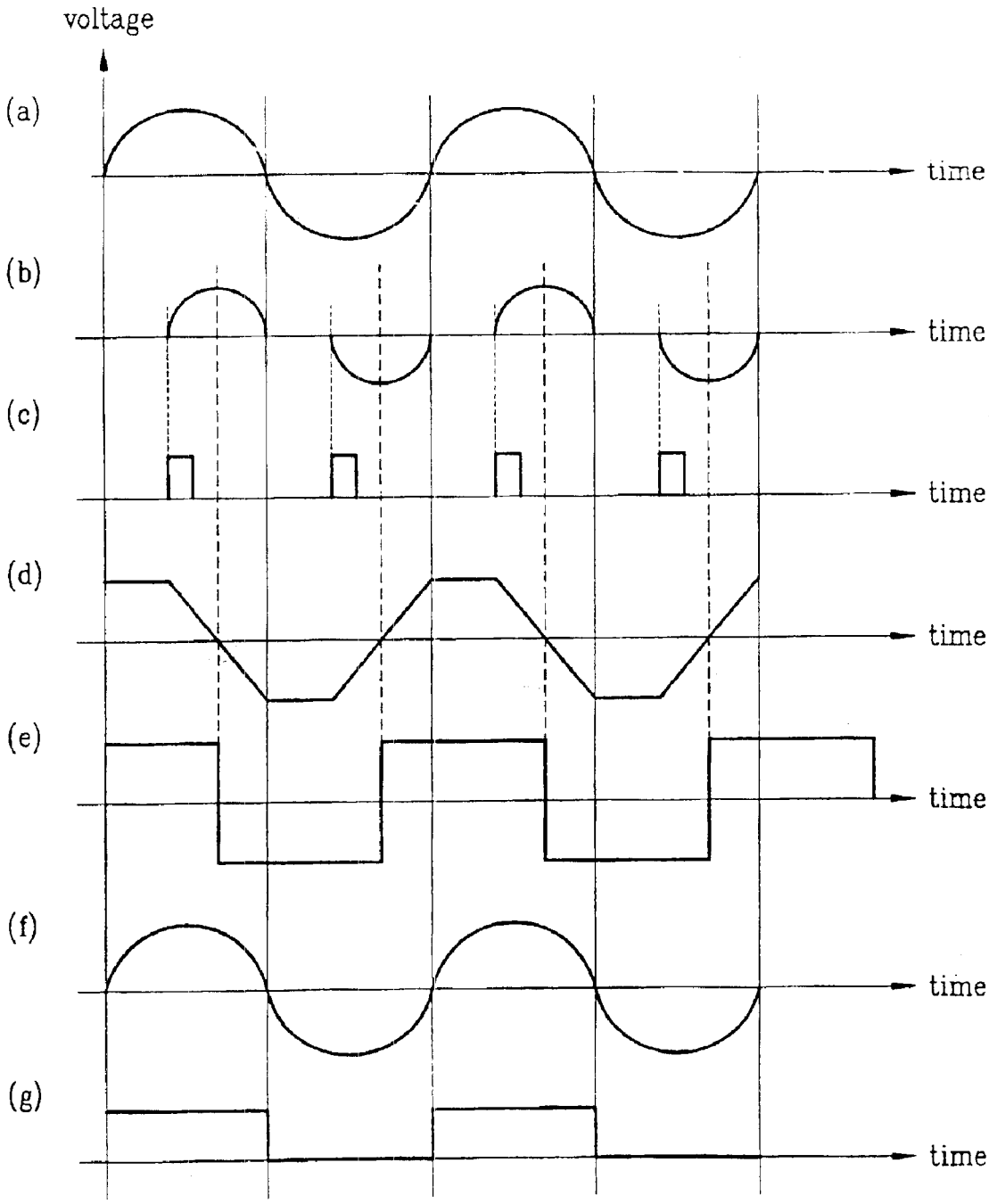
FIG. 6 illustrates waveforms at different components of FIGS. 4 and 5.
Figure 7:
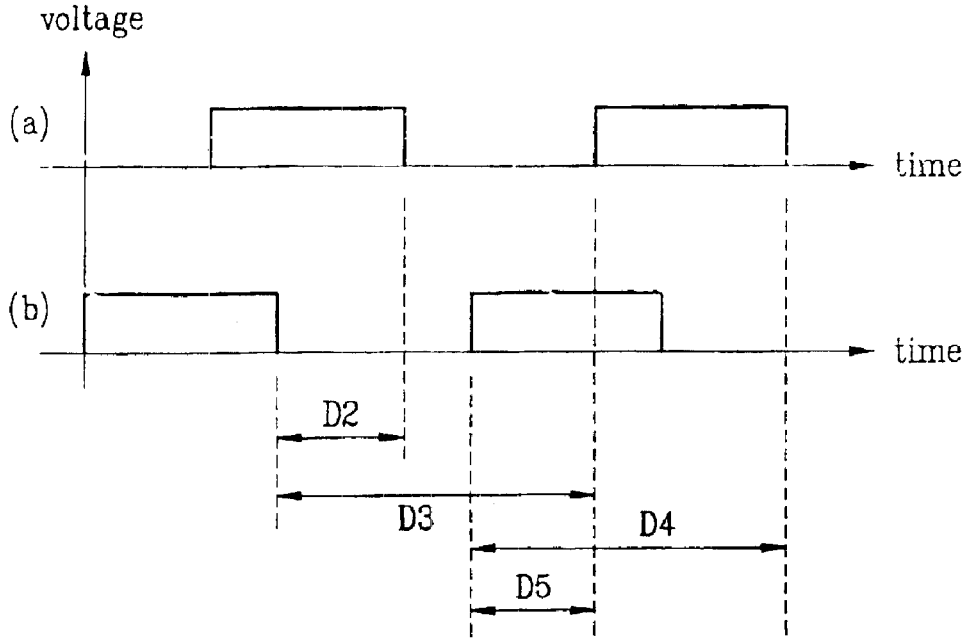
FIG. 7 illustrates a phase difference between a current phase and a stroke phase.
Figure 8:
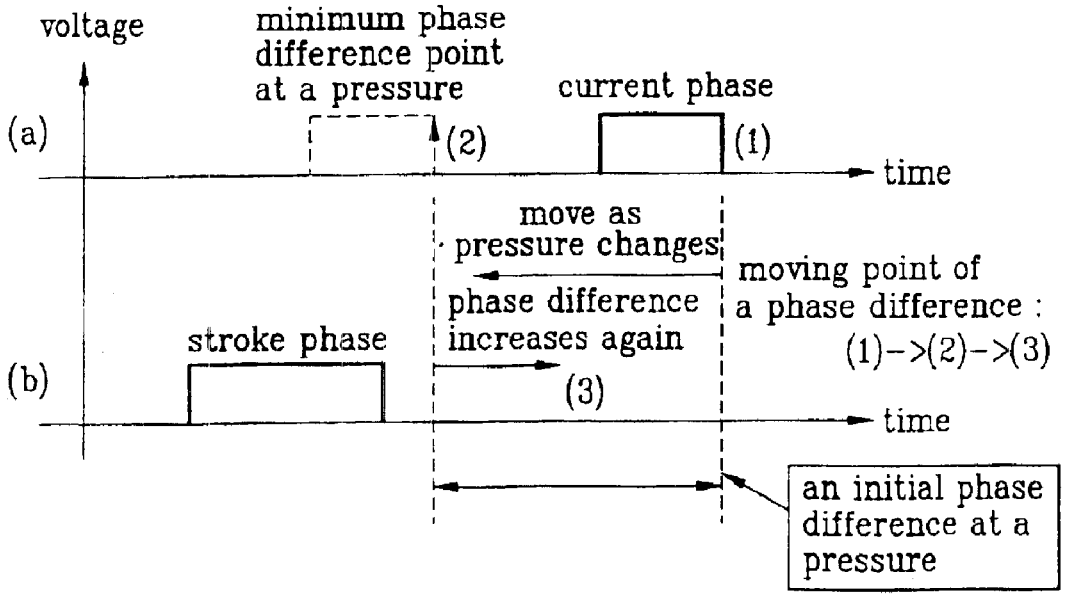
FIG. 8 illustrates shifted paths of a current phase and a stroke phase following pressure changes; and, FIG. 9 illustrates a difference between a current phase and a stroke phase at a pressure.
Figure 9:
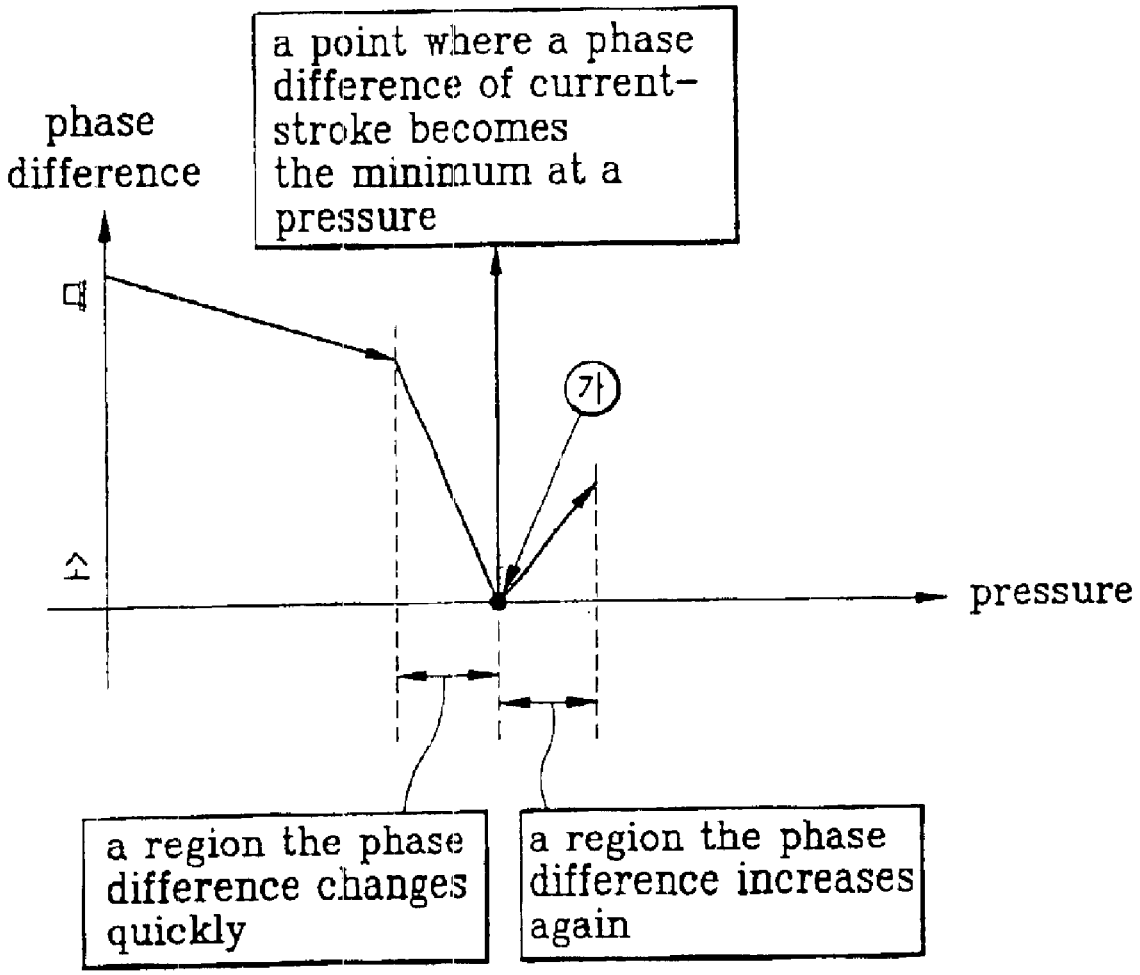

FIG. 6 illustrates waveforms at different components of FIGS. 4 and 5, FIG. 7 illustrates a phase difference between a current phase and a stroke phase, FIG. 8 illustrates shifted paths of a current phase and a stroke phase following pressure changes, and FIG. 9 illustrates a difference between a current phase and a stroke phase at a pressure. What is drawn in the foregoing drawing does not limit the present invention. A method for controlling a piston position in a linear compressor in accordance with a preferred embodiment of the present invention will be explained, with reference to the attached drawings.

Referring to FIG. 4, at an initial operation of the linear compressor, when the phase controlling part 80 provides a triggering signal for a firing angle as shown in FIG. 6(*c*), the triac 20 switches an AC220V as shown in FIG. 6(*a*) supplied thereto. Then, the current phase detecting part 30 detects, integrates a current switched through the triac 20, and generates a first square wave corresponding to the integrated current. That is, the current detecting part 31 of the current phase detecting part 30 detects a current as shown in FIG. 6(*b*) switched through the triac 20. Then, the integrating part 32 integrates the current detected at the current detecting part 31 as shown in FIG. 6(*d*). According to this, the first square wave generating part 33 generates the first square wave corresponding to the current integrated at the integrating part 32 as shown in FIG. 6(*e*). On the other hand, the motor 40 is driven by the power switched at the triac 20, to reciprocate the piston in the cylinder. In this instance, the stroke phase detecting part 50 generates an AC voltage waveform having a fixed frequency and varied amplitude according to a piston reciprocation position, and then it generates the second square wave corresponding to the AC voltage waveform. That is, as shown in FIG. 6(*f*), the stroke generating part 51 of the stroke phase detecting part 50 generates the AC voltage waveform having a fixed frequency and varied amplitude according to a piston reciprocation position. Then, as shown in FIG. 6(*g*) the second square wave generating part generates the second square wave corresponding to the AC voltage waveform generated at the stroke generating part 51. And, the zero cross detecting part 60 detects a zero crossing of the AC220V supplied from the power source 100. Then, the controlling part 70 generates a signal for controlling a piston position according to a phase difference of the first square wave detected at the current phase detecting part 30 and the second square wave generated at the stroke phase detecting part 50. That is, as shown in FIG. 7A, the controlling part 70 provides the signal for controlling a piston position as shown in FIGS. 8 and 9 according to a phase difference between the first square wave detected at the current phase detecting part 30 as shown in FIG. 7(*a*) and the second square wave generated at the stroke phase detecting part 50 as shown in FIG. 7(*b*). According to this, the phase controlling part 80 controls the firing angle for controlling a stroke in response to the control signal from the controlling part 70. Then, the triac 20 switches the voltage supplied from the power source 100 according to the firing angle from the phase controlling part 80. And, as the foregoing steps are repeated, the controlling part 70 detects a piston position at which the top clearance becomes minimized, and provides a signal for controlling the piston position at which the top clearance becomes minimized.

Figure 1:
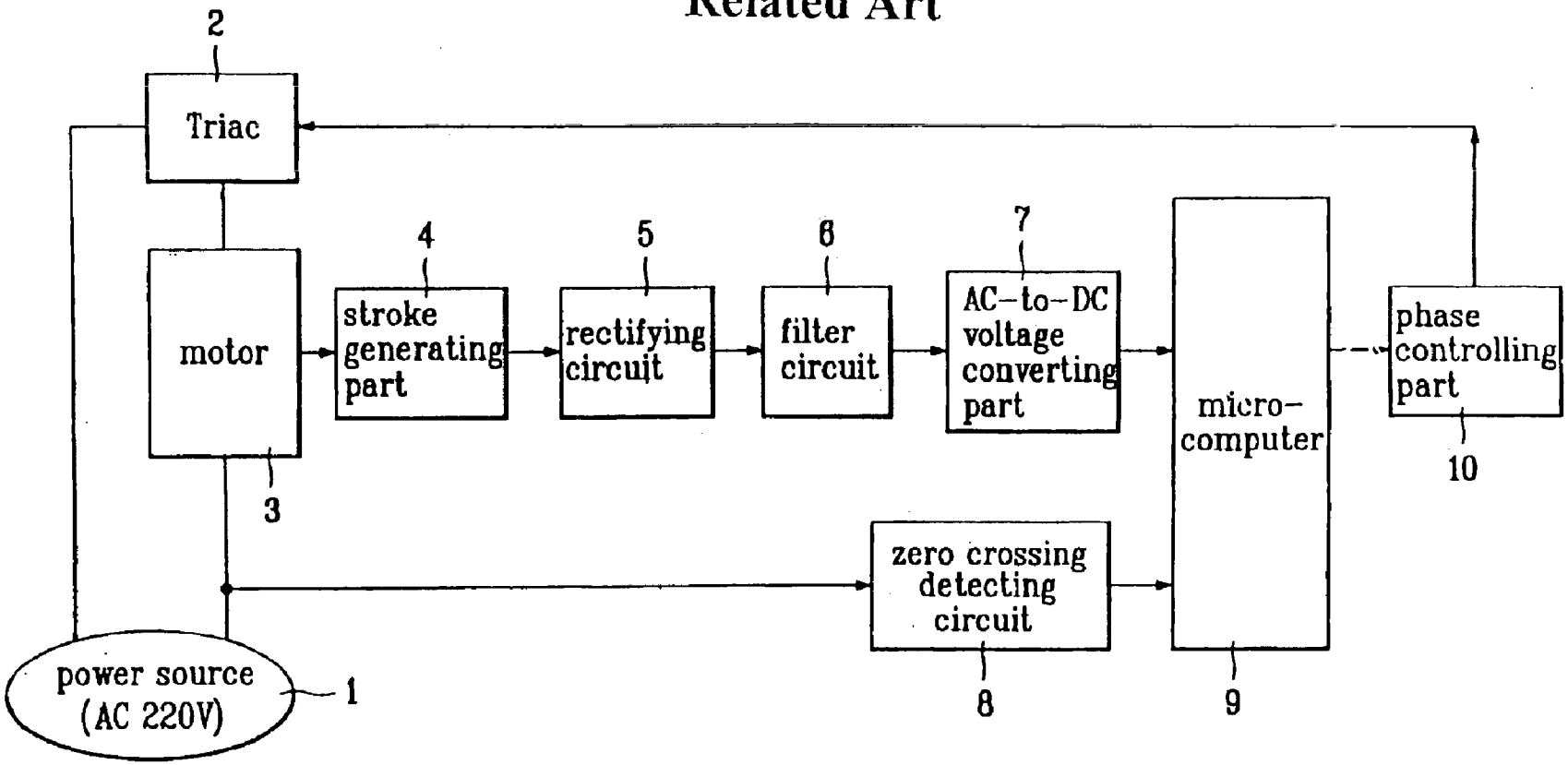
FIG.1 Related Art
FIG. 1 illustrates one example of a background art device for controlling a piston position in a linear compressor.
Figure 2:
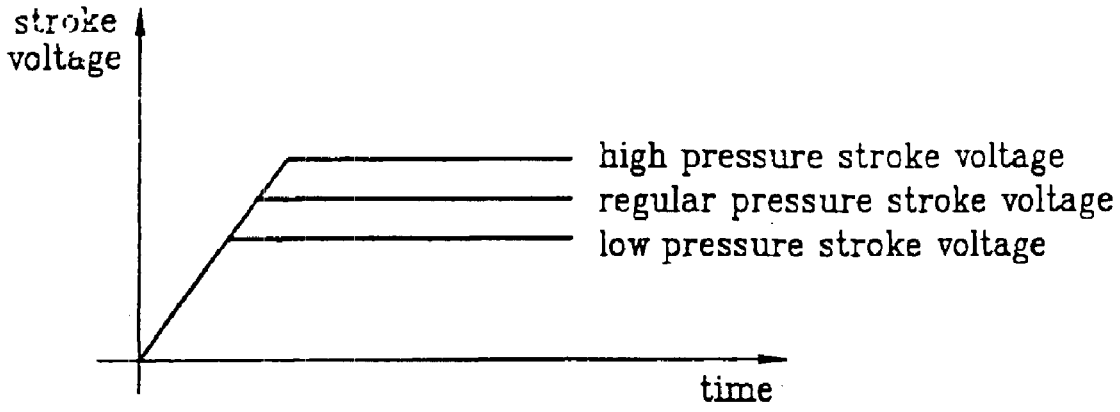
FIG.2 Related Art
FIG. 2 illustrates waveforms of high, regular, and low voltages from the AC-DC voltage transformer in FIG. 1.
Figure 3:
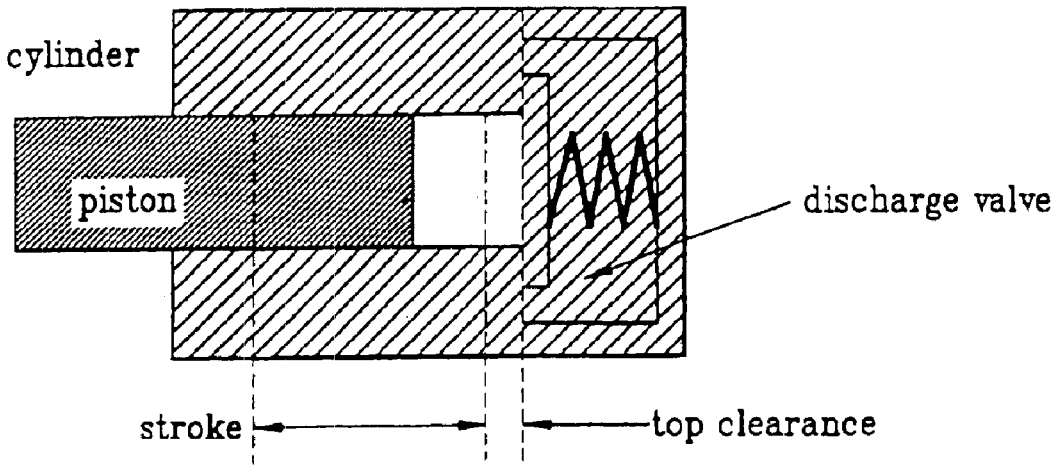
FIG.3 Related Art
FIG. 3 illustrates top clearance.

And, as shown in FIG. 5, the converting part 90 may be added to the system in FIG. 3. The converting part 90 includes the rectifying part 91 and the AC-to-DC converting part 92, wherein the rectifying part 91 rectifies the AC voltage waveform generated at the stroke generating part 51, and the AC-to-DC converting part 92 converts the AC voltage waveform rectified at the rectifying part 91 into a DC voltage waveform corresponding to the AC voltage waveform. Then, the controlling part 70 controls operation according to the DC voltage waveform converted at the AC-to-DC converting part 92, and conducts a process identical to the process shown in FIG. 4.

INDUSTRIAL APPLICABILITY

As has been explained, the device and method for controlling a piston position in a linear compressor has advantages in that an efficiency and a reliability are made the best by controlling a piston position in a cylinder such that a top clearance becomes a minimum according to a phase difference of a current square wave and stroke square wave.

It will be apparent to those skilled in the art that various modifications and variations can be made in the device and method for controlling a piston position in a linear compressor of the present invention without departing from the spirit or scope of the invention. Thus, it is intended that the present invention cover the modifications and variations of this invention provided they come within the scope of the appended claims and their equivalents.

What is claimed is:

1. A device for controlling a piston position in a linear compressor, having a power source, a triac, and a motor, comprising:

a current phase detecting part for detecting a current switched at the triac, integrating the current, and generating a first square wave corresponding to the integrated current;

a stroke phase detecting part for generating an AC voltage waveform having a fixed frequency and varied amplitude according to a piston reciprocation position following motor operation, and generating a second square wave corresponding to the AC voltage waveform;

a zero cross detecting part for detecting a zero crossing of the voltage supplied from the power source; and, a controlling part for generating a signal for controlling a piston position according to a phase difference of the first square wave detected at the current phase detecting part and the second square wave detected at the stroke phase detecting part.

2. A device as claimed in claim 1, wherein the current phase detecting part includes;

a current detecting part for detecting a current switched at the triac, an integrating the current detected at the current detecting part, and a first square wave generating part for generating the first square wave corresponding to the current integrated at the integrating part.

3. A device as claimed in claim 1, wherein the stroke phase detecting part includes;

a stroke generating part for generating the AC voltage waveform having a fixed frequency and varied amplitude according to a piston reciprocation position, and a second square wave generating part for generating the second square wave corresponding to the AC voltage waveform generated at the stroke generating part.

4. A device as claimed in claim 1, wherein the controlling part detects a piston position at which the top clearance becomes a minimum according to a phase difference of the first and the second square waves and provides a signal for controlling the piston position at which the top clearance becomes the minimum.

5. A device as claimed in claim 1, further comprising a phase controlling part for controlling a firing angle for controlling a stroke in response to a control signal from the controlling part and providing to the triac.

6. A device as claimed in claim 5, wherein the triac switches a voltage supplied from a power source according to the firing angle from the phase controlling part.

7. A device for controlling a piston position in a linear compressor, having a power source, a triac, and a motor, comprising:

a current phase detecting part for detecting a current switched at the triac, integrating the current, and generating a first square wave corresponding to the integrated current;

a stroke phase detecting part for generating an AC voltage waveform having a fixed frequency and varied amplitude according to a piston reciprocation position following motor operation, and generating a second square wave corresponding to the AC voltage waveform;

a zero cross detecting part for detecting a zero crossing of the voltage supplied from the power source;

a converting part for rectifying a voltage waveform of a stroke detected at the stroke phase detecting part, and converting the voltage waveform into a DC waveform;

a controlling part for generating a signal for controlling a piston position according to a phase difference of the first square wave detected at the current phase detecting part and the second square wave detected at the stroke phase detecting part, and controlling operation according to the DC waveform converted at the converting part.

8. A device as claimed in claim 7, wherein the converting part includes;

a rectifying part for rectifying the voltage waveform of the stroke detected at the phase detecting part, and an AC-to-DC converting part for converting the rectified voltage waveform into a DC waveform.

9. A device as claimed in claim 7, further comprising a phase controlling part for controlling a firing angle for controlling a stroke in response to a control signal from the controlling part and providing to the triac.

10. A device as claimed in claim 9, wherein the triac switches a voltage supplied from a power source according to the firing angle from the phase controlling part.

11. A method for controlling a piston position in a linear compressor having a power source, a triac, and a motor, the method comprising the steps of:

(1) generating a first square wave corresponding to a current of a voltage switched at the triac;

(2) generating a second square wave corresponding to a stroke occurred as the motor is operated by the voltage; and, (3) controlling a piston position by controlling a phase of voltage switched at the triac according to a phase difference of the first square wave and the second square wave.

12. A method as claimed in claim 11, wherein the step (1) includes the steps of;

detecting a current switched at the triac, and integrating the current to generate a square wave corresponding to the integrated current.

13. A method as claimed in claim 11, wherein the step (2) includes the steps of;

generating an AC voltage waveform having a fixed frequency and varied amplitude according to a piston reciprocation position, and generating a square wave corresponding to the generated AC voltage waveform.

14. A method as claimed in claim 11, wherein the step (3) is the step for providing a control signal for controlling a piston position such that a top clearance becomes a minimum according to a phase difference of the first and second square waves.

15. The method of claim 11 further comprising the step of:

determining the phase difference between the first square wave and the second square wave, prior to said step of controlling the piston position.

16. An apparatus for controlling piston position in a linear compressor, where the linear compressor includes a power source, a triac and a motor, said apparatus comprising:

means for generating a first square wave, wherein the first square wave reflects an amount of current at the triac;

means for generating a second square wave, wherein the second square wave reflects piston position following motor operation;

means for determining a phase difference between the first square wave and the second square wave; and means for controlling piston position as a function of the phase difference between the first square wave and the second square wave.

17. The apparatus of claim 16 further comprising:

means for detecting the current at the triac.

18. The apparatus of claim 16, wherein said means for controlling piston position comprises:

means for generating a control signal, wherein the control signal is a function of the phase difference between the first square wave and the second square wave.

19. The apparatus of claim 18 further comprising:

means for generating a triggering signal for the triac in response to the control signal.

20. The apparatus of claim 19, wherein the triggering signal causes a change in firing angle.

* * * * *